United States Patent [19]

Hibari

[11] Patent Number: 4,569,066

[45] Date of Patent: Feb. 4, 1986

[54] PAPER SHEET COUNTING MACHINE

[75] Inventor: Eiko Hibari, Tokyo, Japan

[73] Assignee: Laurel Bank Machine Co., Ltd., Tokyo, Japan

[21] Appl. No.: 522,699

[22] Filed: Aug. 12, 1983

[30] Foreign Application Priority Data

Aug. 14, 1982 [JP] Japan ..... 57-141380

[51] Int. Cl.[4] ..... G06M 9/02

[52] U.S. Cl. ..... 377/8; 377/17

[58] Field of Search ..... 377/8, 17

[56] References Cited

FOREIGN PATENT DOCUMENTS

| | | | |
|---|---|---|---|
| 607224 | 10/1960 | Canada | 377/8 |
| 140479 | 11/1981 | Japan | 377/8 |
| 27383 | 2/1982 | Japan | 377/8 |
| 56201380 | 6/1983 | Japan . | |
| 56196448 | 6/1983 | Japan . | |
| 57-70859 | 10/1983 | Japan . | |
| 1243785 | 8/1971 | United Kingdom | 377/8 |

*Primary Examiner*—John S. Heyman
*Assistant Examiner*—Karl Ohralik
*Attorney, Agent, or Firm*—Fleit, Jacobson, Cohn & Price

[57] ABSTRACT

Herein disclosed in a paper sheet counting machine which comprises: position detecting means for detecting that suction tubes are in a stand-by position and in a start position; vacuum pressure detecting means for detecting the vacuum pressure prevailing in the suction tubes; and a control unit for driving and controlling a counter motor, a holder motor and a pump motor in response to signals which are fed from the position detecting means and the vacuum pressure detecting means. When the holder is in an open position, the suction tube is set in the stand-by position. After the holder is set in a closed position, the suction tube is then set in the start position to block and seal its inside from the outside. Then, a vacuum pump is driven so that the counting operations are started when the vacuum pressure in the suction tube reaches a predetermined level.

15 Claims, 6 Drawing Figures

PAPER SHEET COUNTING MACHINE

BACKGROUND OF THE INVENTION

1. Field of the Invention

The present invention relates to a paper sheet counting machine for counting the number of paper sheet such as paper currency.

2. Description of the Prior Art

There is known in the prior art a paper currency counting machine in which the sheets of paper currency are sucked and turned over one by one by the vacuum prevailing in suction tubes arranged so rotatably in a rotary cylinder as to revolve on their axes and around the axis of the rotary cylinder in accordance with the rotations of the rotary cylinder so that the number of the paper sheets may be counted in terms of the output signal of a sensor made detective of the passage of the suction tubes. The present Applicant has already made proposals such as Japanese Patent Application No. 57-70859, 56-201380 or 56-196448. Now, these proposals have such advantages and subject matters to be aimed at as will be described in the following. In the Japanese Patent Application No. 57-70859, specifically, suction tubes are located by means of both operation members (iron members, for example) arranged on the outer circumference of a rotary cylinder in a manner to correspond to the suction tubes and a sensor for detecting the operation members so that one suction tube may be stopped at a stand-by position (in which it substantially faces the paper sheets to be counted). As is different from the prior art method by which the stop is mechanically effected, therefore, the suction tube can be stopped with neither fail nor chattering at the stand-by position. Despite of this advantage, however, there are left as the subject matters the points that a long time elapses before the paper sheets are sucked and that the counting operations are not started, in case the paper sheets are unabled to be sucked by the suction tube as a result of disturbances of the paper sheets, so that a vacuum pump is left continuously rotating.

Next, in the Japanese Patent Application No. 56-201380, in order to eliminate the aforementioned disadvantages, the suction tube is set in advance prior to the start of the counting operations not in the stand-by position but in a start position, in which the suction tube has its inside blocked and sealed from the outside, and a vacuum pump is driven so that the counting operations are started when the vacuum pressure prevailing in the suction tube reaches a predetermined level. As a result, the start of the counting operations is ensured, but the paper sheets are liable to be folded between the suction tubes in some cases in which a mistake in the counting operations may take place. In order to obviate this mistake, therefore, there arises a disadvantage that a regulating member for firmly holding the paper sheets in position on the holder is made indispensable to complicate the overall construction.

In the Japanese Patent Application No. 56-196448, on the other hand, the holder charged up with the paper sheets is swung from a charge position (or an open position) to a count position (or a closed position), and the suction tubes are inversely revolved around a rotary cylinder carrying the suction tubes by inversely rotating the rotary cylinder so that the paper sheets can be prevented from being folded between the suction tubes. Depending upon the positions of the suction tubes when the holder is set in the closed position, however, the holder exerts a strong thrust upon the suction tube during the aforementioned inverse rotation so that the counter motor is brought into an overload state to invite a disadvantage that the motor has its performance deteriorated. In order that just after completeness of reverse revolution of the suction tubes the suction tube may be forwardly revolved for its sucking and turning over operations, moreover, a conduit for providing communication between the suction tube and a vacuum pump is blocked and sealed from the outside by the action of a solenoid valve to raise the vacuum pressure in the aforementioned conduit in advance thereby to make it necessary to increase the suction of the suction tube. This necessity invites a disadvantage that the construction is also complicated.

SUMMARY OF THE INVENTION

It is, therefore, an object of the present invention to provide a simply constructed paper sheet counting machine from which the aforementioned disadvantages and the erroneous operation at the start of the counting operations are eliminated.

According to a major feature of the present invention, there is provided a paper sheet counting machine comprising: a holder for swinging paper sheets en masse from an open position in which they can be charged to a closed position in which they can be counted; a rotary cylinder made rotatable on the axis thereof and having communication with a vacuum pump; a plurality of suction tubes received so rotatably in said rotary cylinder as to revolve on the respective axes thereof and around the axis of said rotary cylinder and having communication with said vacuum pump through said rotary cylinder for sucking and turning over said paper sheets one by one by the vacuum; and means for sequentially counting the paper sheets peeled, wherein the improvement comprises: a counter motor for rotationally driving said suction tubes; a holder motor for effecting the swinging motions of said holder; a pump motor for driving said vacuum pump to establish said vacuum; position detecting means for detecting that one of said suction tubes are in a stand-by position, in which it correctly faces the paper sheets in said closed position, and in a start position in which the same has its inside blocked and sealed from the outside; vacuum pressure detecting means for detecting the vacuum pressure in said suction tubes; and a control unit which is made operative: (a) to drive said counter motor, after it had driven said holder motor to set said holder in said open position, thereby to set one of said suction tubes in said stand-by position in response to a signal fed from said position detecting means; (b) to inversely drive said counter motor, after it has driven said holder motor to set said holder in said closed position, thereby to set said suction tubes in said start positions in response to a signal fed from said position detecting means; and (c) to drive said pump motor thereby to start the sucking and turning over operations by said suction tubes, when the vacuum pressure in said suction tubes reaches a predetermined level, in response to a signal fed from said vacuum pressure detecting means.

BRIEF DESCRIPTION OF THE DRAWINGS

Other objects, features and advantages of the present invention will become apparent from the following description taken in conjunction with the accompanying drawings, in which.

DESCRIPTION OF THE PREFERRED EMBODIMENTS

Figure 1:
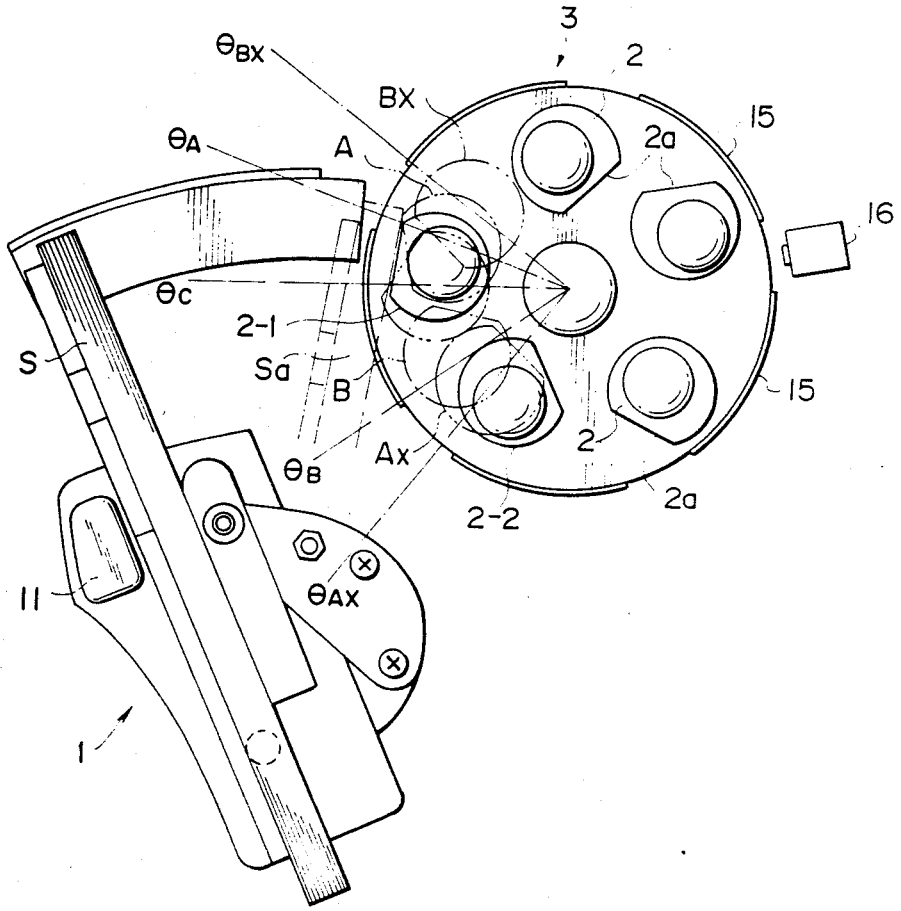
FIG. 1 is a top plan view showing an essential portion of a counting mechanism.
Figure 2:
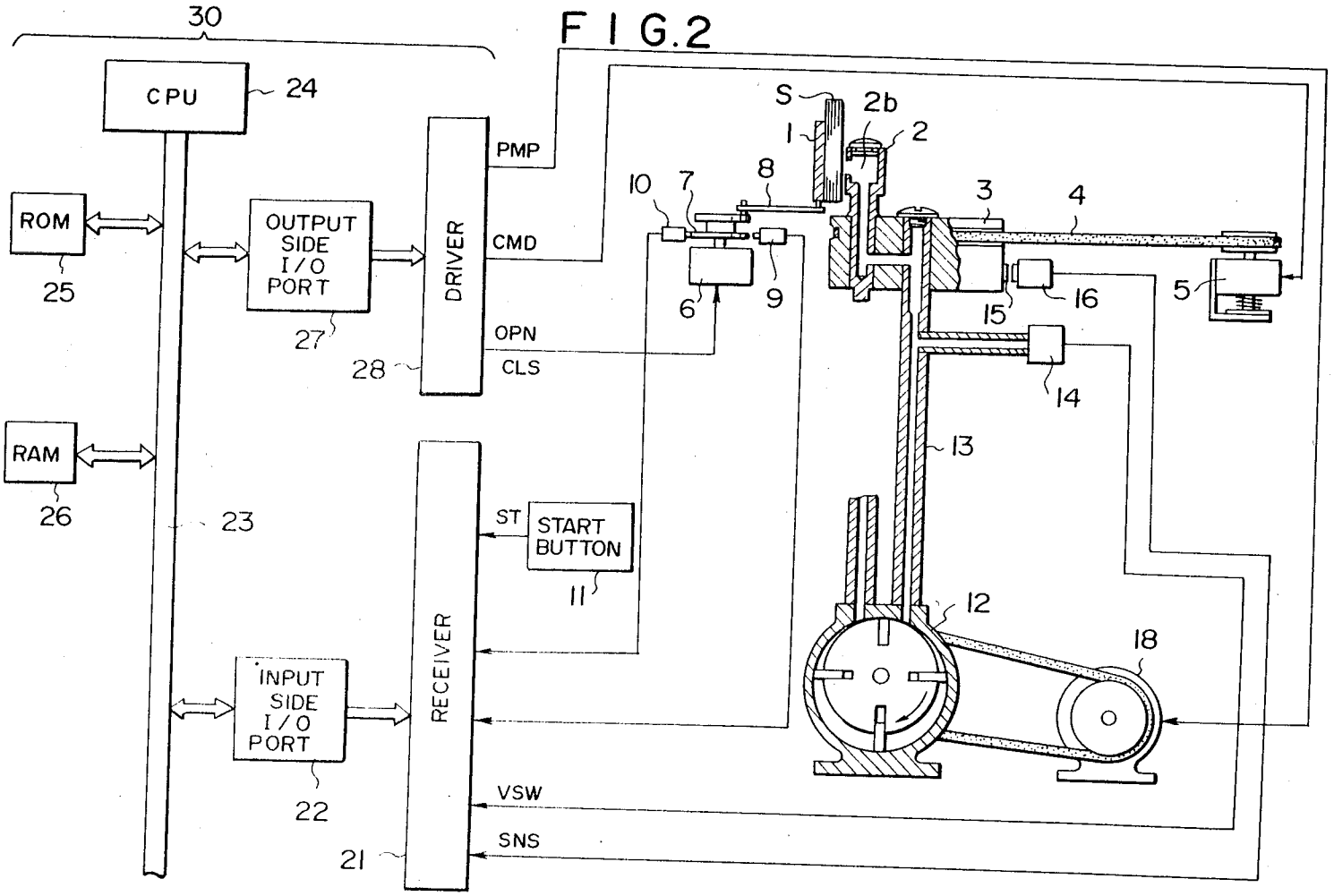
FIG. 2 is a schematic view showing the constructions of the counting mechanism and a control unit.

The present invention will be described in the following in connection with the embodiment thereof with reference to the accompanying drawings. FIG. 1 is a top plan view showing the essential portion of a counting mechanism, and FIG. 2 is a schematic view showing the relationship between the counting mechanism and a control unit. In these Figures, reference numeral 1 generally indicates a holder. If paper sheets S are placed on the holder 1 and set such a count position (or a closed position) as is indicated by a single-dotted line in FIG. 1, one of suction tubes 2 is brought into a state in which it can contact with the paper sheets S. If, at this time, a rotary cylinder 3 carrying the suction tubes 2 is rotated counterclockwise, the suction tubes 2 themselves suck and turn over the paper sheets S one by one by the vacuum established therein, while the suction tubes rotate clockwise on their axes, thereby to count the paper sheets S. In this connection, the rotary cylinder 3 is driven by a counter motor 5 through an endless belt 4.

In a meanwhile, the holder 1 is connected to a holder control cam 7, which is rotationally driven by a holder motor 6, through a link 8 so that it is swung into a closed state toward the suction tubes 2 or into an open state in the opposite direction by the rotations of the holder control cam 7. Around the outer circumference of this holder control cam 7, there are disposed an open-position detecting switch 9 and a closed-position detecting switch 10 for detecting the open and closed positions of the holder 1. On the upper surface of the holder 1, there is mounted a start button 11 for starting the counting operations.

The aforementioned suction tubes are made hollow, as shown in FIG. 2, and are opened at their flattened sucking faces 2*a*. Those suction tubes 2 have their hollow portions 2*b* communicating with a vacuum pump 12 by way of a conduit 13, from which there is branched a vacuum switch 14. To the outer circumference of the rotary cylinder 3, moreover, there are attached operation members 15 (such as iron members) which are positioned to correspond to the suction tubes 2. A sensor 16 for detecting the approach of one of the operation members 15 is disposed at a position to face one of the operation members 15.

The start position and the stand-by position will be described in the following with reference to FIG. 1.

As shown in FIG. 1, the suction tube 2 revolves on its axis from the state indicated by a double-dotted line A to the state indicated by a double-dotted line B when the rotary cylinder 3 rotates from a position $\theta_A$ to a position $\theta_B$. Within this range, the suction tube 2 has its inside communicated with the vacuum pump 12 so that it can suck one of the paper sheets S. On the other hand, in another state, the suction tube 2 has its inside held in a state in which it is blocked from the vacuum pump 12. When the first suction tube 2 has its center positioned at the position $\theta_B$, on the other hand, the next suction 2 is held in a position $\theta_{BX}$ which is indicated by a double-dotted line BX. While that suction tube 2 is moving from the position $\theta_{BX}$ to the position $\theta_A$, the first suction tube 2 moves from the position $\theta_B$ to a position $\theta_{AX}$. As a result, while the suction tube is rotating from the position $\theta_{BX}$ to the position $\theta_A$, all of the suction tubes 2 have their insides blocked from the vacuum pump 12. And, this time period $\theta_{BX}$ to $\theta_A$ will be called a "start position".

On the other hand, a stand-by position $\theta_A$ to $\theta_C$ is so set as to satisfy the following conditions:

(a) At the stand-by position $\theta_A$ to $\theta_C$, the sucking face 2*a* can substantially face the paper sheets S indicated by the single-dotted lines;

(b) When the suction tube 2 inversely moves from the stand-by position $\theta_A$ to $\theta_C$ to the start position $\theta_{BX}$ to $\theta_A$, the thrust to be applied from the holder 1 to the suction tube 2 is so weak that no overload is exerted upon the counter motor 5; and (c) None of the paper sheets S is folded between the suction tubes 2.

Thus, the start position $\theta_{BX}$ to $\theta_A$ and the stand-by position $\theta_A$ to $\theta_C$ are determined. Moreover, the sensor 16 and the operation members 15 are so arranged that they face each other when the suction tube 2 is outside of the stand-by position $\theta_A$ to $\theta_C$ thereby to turn on the sensor 16.

Next, as shown in FIG. 2, the output signals of the start button 11, the holder open-position detecting switch 9, the holder closed-position detecting switch 10, the vacuum switch 14 and the sensor 16 are received by a receiver 21 from which they are transmitted through an input side I/O port 22 and a bus 23 to a CPU (central processing unit) 24. This CPU conducts the following processings in accordance with the program, which is stored in an ROM (i.e., Read Only Memory) 25, and feeds an output instruction through the bus 23 and an output side I/O port 27 to a driver 28, which in turn drives and controls the holder motor 6, the counter motor 5 and a pump motor 18. Incidentally, an RAM 26 is a random access memory. Moreover, those parts or elements 21 to 28 constitute together a control unit 30.

The operations of the present embodiment will be described in the following with reference to the time chart of FIG. 3 and the flow chart of FIG. 4.

(1) In case the holder is set in its open position and the suction tube 2 is set in its stand-by position:

When the operator turns on the power source of the paper sheet counting machine, the control unit 30 drives the holder motor 6 to set the holder 1 in the open position in case the holder open-position detecting switch 9 is off. In case the sensor 16 is on, the control unit 30 then drives the counter motor 5 to rotate the rotary cylinder 3 forward (i.e., counterclockwise) at a low speed thereby to set the suction tube 2 in the stand-by position in which the sensor 16 is off.

Figure 3:
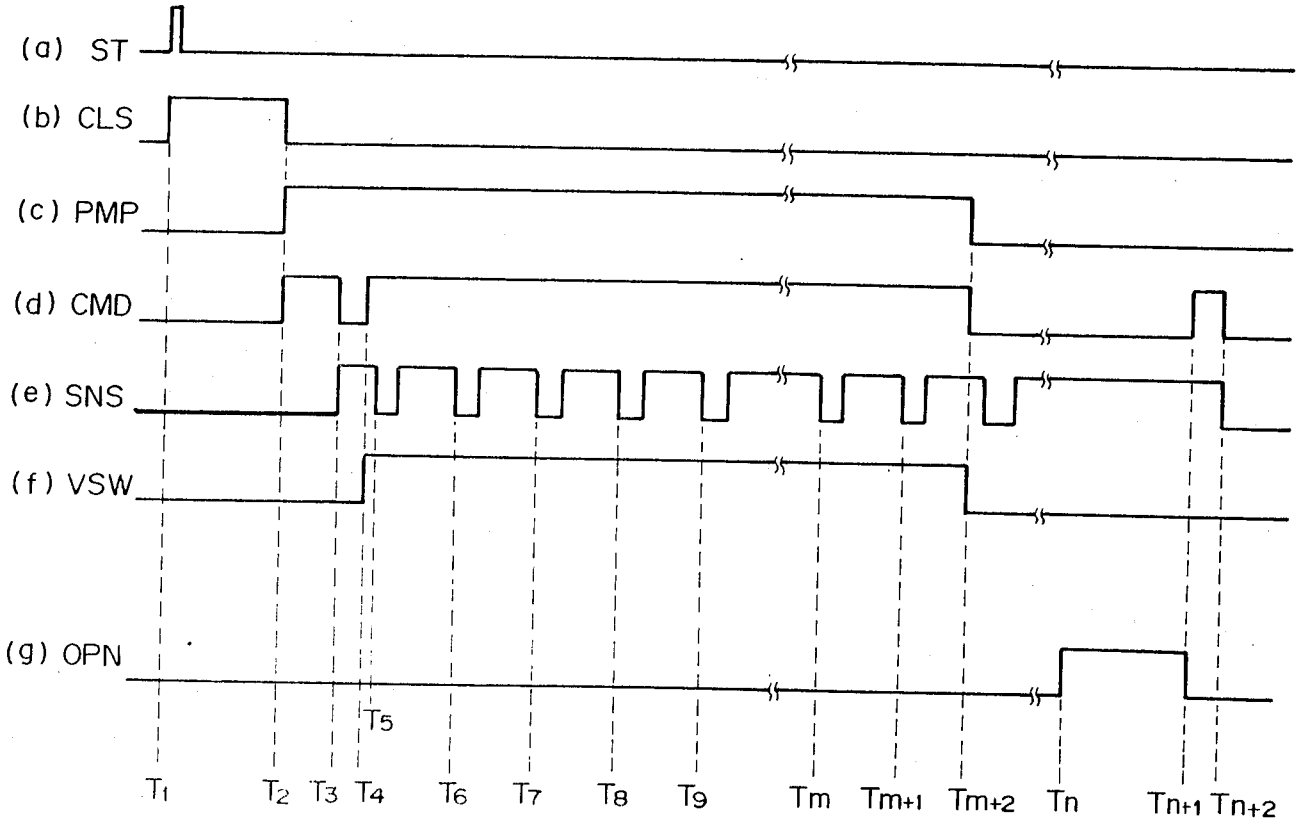
FIG. 3 is a time chart for explaining the operations of an embodiment of the present invention.
Figure 4:
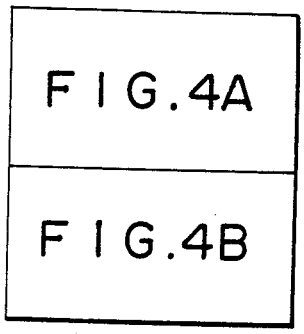
FIG. 4 is a flow chart for explaining the operations of the same embodiment.
Figure 4A:
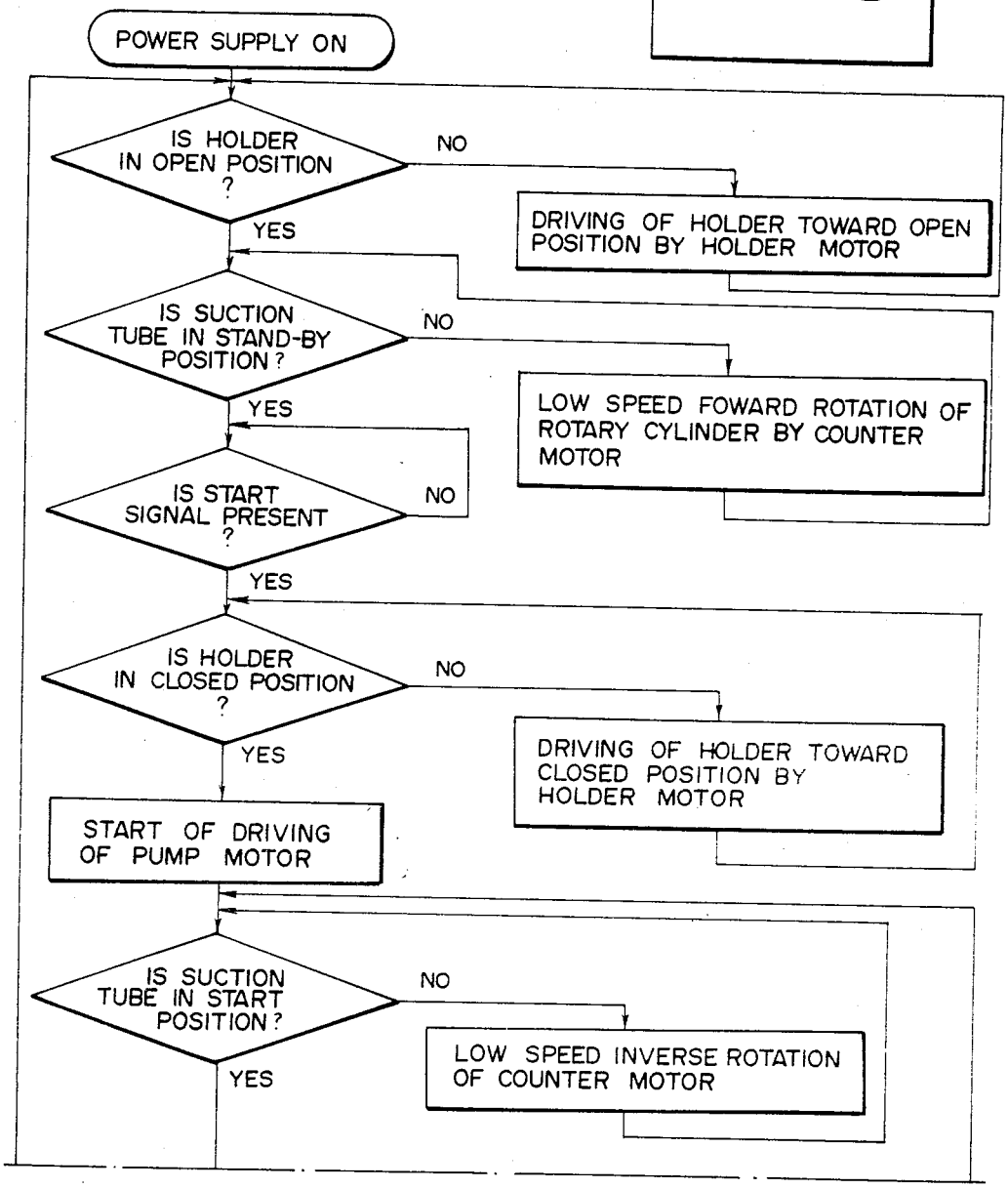
Figure 4B:
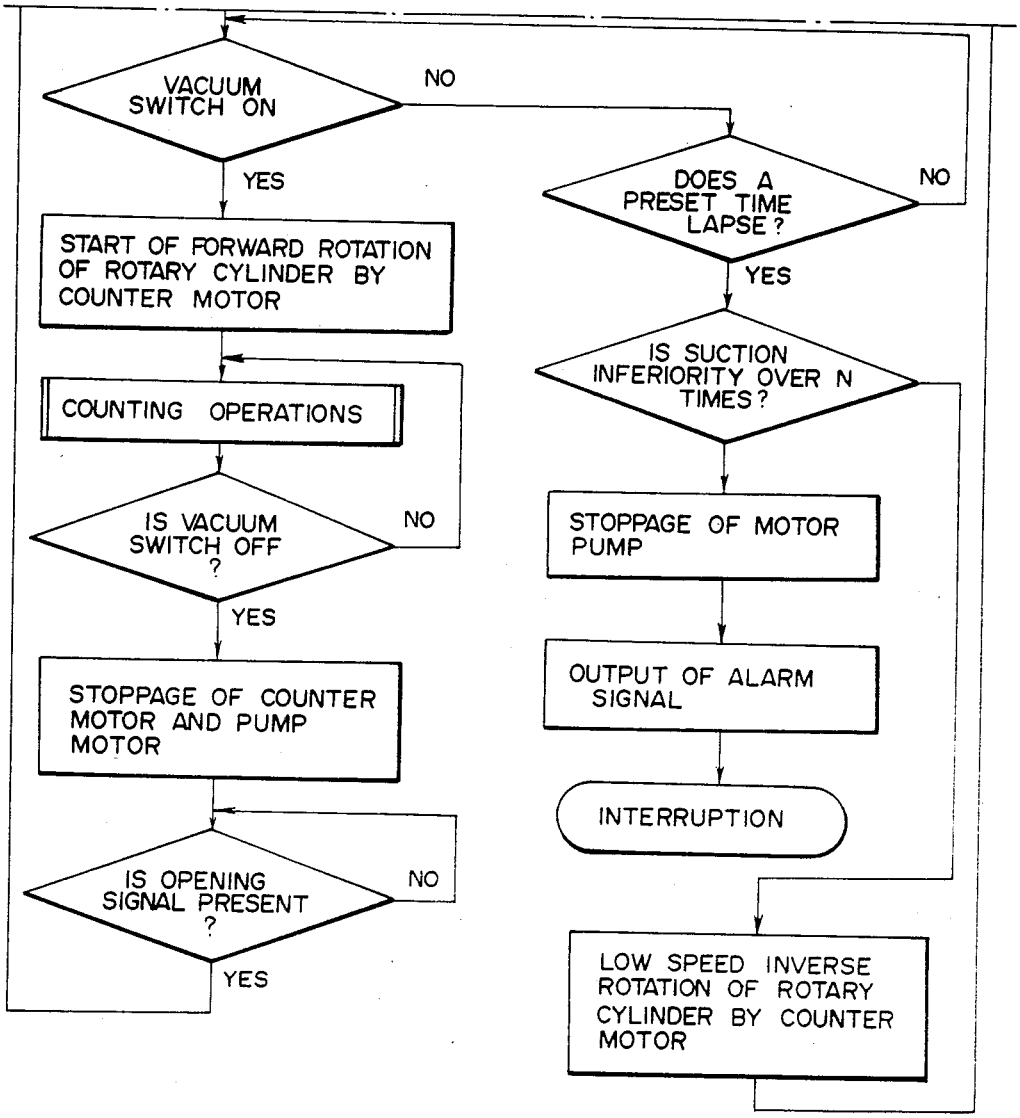

(2) When the holder is charged with the paper sheets S, the start button 11 is depressed, and the holder 1 is set in its closed position:

The operator charges the holder 1 with the paper sheets S and depresses the start button 11, a start signal ST indicated in FIG. 3(*a*) is fed at a time $T_1$ to the control unit 30 so that this control unit 30 feeds out a holder motor closing signal CLS appearing in FIG. 3(*b*) to drive the holder motor 6, until the holder closed-position detecting switch 10 is turned on, thereby to set the holder 1 in the closed position. At this time, since the suction tube 2 is in the stand-by position $\theta_A$ to $\theta_C$, the foremost one of the paper sheets S held on the holder 1 is held down by the suction tube 2 so that it is prevented from being folded between the sucking tubes 2.

(3) In case the pump motor 18 starts its drive and the suction tube 2 is moved to the start position:

If the holder 1 is set in the closed position at a time $T_2$ of FIG. 3, the control unit 30 drives the pump motor 18 in response to a pump motor driving signal PMP of FIG. 3(*c*) to start the run of the vacuum pump 12 and generates a counter motor driving signal CMD of FIG. 3(*d*) to inversely rotate the counter motor 5 at a low speed. As a result, the rotary cylinder 3 and the suction tubes 2 also rotate at a low speed so that the suction tube 2 moves from the stand-by position $\theta_A$ to $\theta_C$ to the start position $\theta_{BX}$ to $\theta_A$ of FIG. 1. Moreover, if the suction tube 2 exceeds the boundary $\theta_A$ of those two positions at a time $T_3$ of FIG. 3, the operation member 15 is detected by the sensor 16 so that an output signal SNS of FIG. 3(*e*) is generated. In response to this signal SNS, the control unit 30 stops the low-speed inverse rotations of the counter motor 5 so that the suction tube 2 moves from the stand-by position $\theta_A$ to $\theta_C$ to stop at the start position $\theta_{BX}$ to $\theta_A$. As a result, the suction tubes 2 have their insides blocked from the vacuum pump 12, and the conduit 13 has its inside sealed up. Since the inside of the conduit 13 still has communication with the vacuum pump 12, moreover, the inside vacuum level is gradually raised. Incidentally, while the suction tube 2 is revolved from the stand-by position $\theta_A$ to $\theta_C$ to the start position $\theta_{BX}$ to $\theta_A$, the paper sheets S can be avoided from being folded between the suction tubes 2 by inversely revolving the rotary cylinder 3. In this meanwhile, moreover, since the thrust to be applied from the holder 1 to the suction tube 2 is weak so that the counter motor is prevented from being overloaded, it is possible to prevent the counter motor 5 from having its performance affected by being overloaded.

(4) In case the counting operations are started:

When the suction tube 2 comes to the start position $\theta_{BX}$ to $\theta_A$, as has been described hereinbefore, its inside is blocked from the vacuum pump 12, and the conduit 13 has its inside sealed so that the vacuum switch 14 is operated within a short time period by the drive of the vacuum pump 12. At a time $T_4$ shown in FIG. 3, moreover, a vacuum switch output signal VSW of FIG. 3(*f*) is fed to the control unit 30. As a result, the control unit 30 rotates forward the counter motor 5 at a high speed in response to the counter motor driving signal CMD of FIG. 3(*d*) so that the suction tubes 2 start their revolutions on their respective axes and around the axis of the rotary cylinder 3. Thus, by setting the suction tube 2 in the start position $\theta_{BX}$ to $\theta_A$, a vacuum state can be established without fail in the coduit 13 so that a reliable start of the counting operations can be accomplished.

(5) In the case of the counting operations:

When the counting operations are started so that the center of the suction tube 2 having been positioned in the start position $\theta_{BX}$ to $\theta_A$ is displaced counterclockwise about the axis of cylinder 3 from the position $\theta_A$ at a time $T_5$ shown in FIG. 3, the hollow portion 2*b* of the suction tube 2 restores its communication with the conduit 13 and is instantly occupied by the vacuum so that the first paper sheet S is sucked onto the sucking face 2*a* of that particular suction tube 2 and so that the sensor 16 is turned off, as shown in FIG. 3(*e*), to generate a first "off" signal after the start of the counting operations. In the embodiment under consideration, the first "off" signal is not utilized. As a result that the suction tube 2 is further rotated counterclockwise about the axis of cylinder 3, moreover, the first paper sheet S is turned over out to the position between the suction tube 2 indicated by the double-dotted line B and the next suction tube 2 indicated by the double-dotted line BX of FIG. 1. At this time, when the sucking operation of the suction tube 2 is stopped so that the suction tube 2 having finished its sucking operation moves to the position indicated by the double-dotted line AX of FIG. 1, the next suction tube 2 moves from the position of the double-dotted line BX to the position of the double-dotted line A so that the sensor 16 is turned off, as indicated in FIG. 3(*e*), at a time $T_6$ of FIG. 3 to feed the "off" signal to the control unit 30. As a result, this control unit 30 conducts its counting operation of the first sheet. At the same time, the center of the next suction tube 2 moves counterclockwise about the axis of cylinder 3 from the position $\theta_A$ of FIG. 1 to effect the suction of the second sheet. The operations thus far described are repeated (as indicated at instants $T_7$, $T_8$, . . . , and $T_{m+1}$).

(6) At the end of the counting operations:

Next, when the counting operations are completed by turning over all the paper sheets S on the holder 1 at a time $T_{m+2}$ of FIG. 3, the sucking face 2*a* of the suction tube 2 is not closed by the paper sheets S but opened so that the vacuum level of the conduit 13 is dropped to turn off the vacuum switch output signal VSW shown in FIG. 3(*f*). As a result, the control unit 30 turns off the pump motor driving signal PMP, as indicated in FIG. 3(*c*), to stop the run of the pump motor 18 and to turn off the counter motor driving signal CMD of FIG. 3(*d*) thereby to stop the run of the counter motor 5. At this time, an electric brake is also applied to promptly stop the rotary cylinder 3 without fail.

(7) In case the holder 1 is set in the open position and the suction tube 2 is set in the stand-by position:

When the rotary cylinder 3 is stopped, the control unit 30 drives the holder motor 6 at a time $T_n$ of FIG. 3 in response to a holder motor opening signal OPN of FIG. 3(*g*) to shift the holder 1 to an open position. If the holder open position detecting switch 9 is turned off at a time $T_{n+1}$, moreover, the control unit 30 turns off the holder motor opening signal OPN to stop the holder motor 6. Next, the control unit feeds out the counter motor driving signal CMD of FIG. 3(*d*) to rotate the counter motor 5 forward at the low speed. If the sensor output signal SNS of FIG. 3(*e*) is turned off at a time $T_{n+2}$, the control unit 30 turns off the counter motor driving signal CMD to stop the counter motor 5. Thus, the suction tube 2 is stopped at the stand-by position in which the sensor output signal SNS is off. At this time, the counter motor 5 is rotated forward at the low speed partly because the suction tube 2 is stopped at the stand-by position without fail and partly because it is intended to prevent a portion of the paper sheet S having been counted and turned over from being turned over again toward the holder 1 and from being broken (Those undesirable phenomena occur when the counter motor 5 is inversely rotated.).

Here, if, in case the suction tube 2 is to be shifted in the aforementioned operations from the stand-by position $\theta_A$ to $\theta_C$ to the start position $\theta_{BX}$ to $\theta_A$, it is caused by the malfunction or the like of a brake system to stop at a point far from the start position $\theta_{BX}$ to $\theta_A$ so that the inside of the conduit 13 is neither blocked nor sealed from the outside, the suction pressure fails to reach a predetermined level so that there is a fear that the pump motor 18 is left running. In order to avoid this phenomenon, the control unit 30 detects the time period after it has inversely rotated the counter motor 5 at the time $T_2$ of FIG. 3 and before the vacuum switch 14 is turned on. In case a predetermined time period lapses, the control unit 30 inversely rotates again the counter motor 5 to set another suction tube 2 in the start position $\theta_{BX}$ to $\theta_A$, thus effecting the inversely rotating and resetting operations.

On the other hand, in case the vacuum switch 14 is not turned on despite the fact that the aforementioned inversely rotating and resetting operations are conducted consecutively several times, the control unit 30 generates an alarm so as to prevent the pump motor 18 from being left continuously rotating, in case the times of the inversely rotating and resetting operations exceed a predetermined number, thereby to bring the machine as a whole into a stopped state. The causes for those troubles are considered to come from the troubles of the system including the conduit 13, the malfunction of the vacuum switch 14 and so on.

Next, with a view to enhancing the braking effect when the run of the counter motor 5 is to be stopped and to preventing the rotary cylinder 3 from being displaced in its stopped state, the electric brake is used together at the stop, and a mechanical brake having a high stopping torque is attached to the counter motor 5 to lock the rotary cylinder 3 thereby to take it into consideration that the stop position of the suction tube 2 be not displaced.

According to the present invention, as has been described hereinbefore, the rotary cylinder is rotated forward in the state, in which the holder is opened, to set at first the suction tube in the stand-by position, and the suction tube is moved to the start position, while the rotary cylinder is being inversely rotated at the low speed, after the holder has been closed, thereby to start the counting operations. By virtue of the simple construction, therefore, it is possible to ensure the start of the counting operations and to prevent the paper sheets from being folded between the suction tubes. Moreover, it is possible to prevent the counter motor from being strained without overloading the counter motor during the aforementioned inverse rotations of the rotary cylinder. In order to prevent the pump motor from being left rotating, moreover, there are provided means for inversely rotating and resetting the suction tube to the start position and means for alarming upon failure. These provisions make it possible to prevent the pump motor from being excessively used. Since the stand-by position and the start position of the suction tube can be detected by means of the single sensor, still moreover, the construction can be simplified. Since the electric brake is used together when the rotary cylinder is stopped, there can be attained another advantage that the rotary cylinder can be stopped without fail.

What is claimed is:

1. A paper sheet counting machine comprising:

a holder for holding paper sheets en masse in an open position for charging said paper sheets and in a closed position for counting said paper sheets;

a rotary cylinder rotatable on its axis;

a vacuum pump being in communication with said rotary cylinder;

a plurality of suction tubes rotatably received in said rotary cylinder to revolve on their respective axes and to revolve around the axis of said rotary cylinder and being in communication with said vacuum pump through said rotary cylinder for sucking and turning over said paper sheets one by one by a vacuum force;

means for sequentially counting the paper sheets turned over by said plurality of suction tubes;

a counter motor for rotationally driving said plurality of suction tubes to a stand-by position and a start position;

a holder motor for swinging said holder between said open position and said closed position;

a pump motor for driving said vacuum pump to establish said vacuum force;

position detecting means for detecting when one of said plurality of suction tubes is in said stand-by position, in which said one tube correctly faces the paper sheets in said closed position, and when one of said plurality of tubes is in said start position;

vacuum pressure detecting means for detecting the vacuum force in said suction tubes; and a control unit operating:

(a) to drive said counter motor, after said counter motor has driven said holder motor to set said holder in said open position, thereby to set one of said plurality of suction tubes in said stand-by position in response to a signal fed from said position detecting means;

(b) to inversely drive said counter motor, after said counter motor has driven said holder motor to set said holder in said closed position, thereby to set said one suction tube in said start position in response to a signal fed from said position detecting means; and (c) to drive said pump motor thereby to start the sucking and turning over operations by said plurality of suction tubes, when the vacuum force in said one suction tube reaches a predetermined level, in response to a signal fed from said vacuum pressure detecting means.

2. A paper sheet counting machine as set forth in claim 1, wherein said position detecting means includes a position sensor for detecting both said stand-by and said start positions.

3. A paper sheet counting machine as set forth in claim 1, wherein said plurality of suction tubes are rotated in a first direction at a low speed so that one of said plurality of suction tubes is set at said stand-by position in response to the signal fed from said position detecting means.

4. A paper sheet counting machine as set forth in claim 3, wherein said suction tubes are rotated in a second direction opposite to said first direction at a low speed so that said plurality of suction tubes are set at said start positions in response to the signal fed from said position detecting means.

5. A paper sheet counting machine as set forth in claim 1, wherein said suction tubes are driven by the counter motor having a high stopping torque.

6. A paper sheet counting machine comprising:

a holder for holding paper sheets en masse in an open position for charging said paper sheets and in a closed position for counting said paper sheets;

a rotary cylinder rotatable on its axis;

a vacuum pump being in communication with said rotary cylinder;

a plurality of suction tubes rotatably received in said rotary cylinder to revolve on their respective axes and to revolve around the axis of said rotary cylinder and being in communication with said vacuum pump through said rotary cylinder for sucking and turning over said paper sheets one by one by a vacuum force;

means for sequentially counting the paper sheets turned over by said plurality of suction tubes;

a counter motor for rotationally driving said plurality of suction tubes to a stand-by position and a start position;

a holder motor for swinging said holder between said open position and said closed position;

a pump motor for driving said vacuum pump to establish said vacuum force;

position detecting means for detecting when one of said plurality of suction tubes is in said stand-by position, in which said one tube correctly faces the paper sheets in said closed position, and when one of said plurality of tubes is in said start position;

vacuum pressure detecting means for detecting the vacuum force in said suction tubes; and a control unit operating:

(a) to drive said counter motor, after said counter motor has driven said holder motor to set said holder in said open position, thereby to set one of said plurality of suction tubes in said stand-by position in response to a signal fed from said position detecting means;

(b) to inversely drive said counter motor, after said counter motor has driven said holder motor to set said holder in said closed position, thereby to set said one suction tube in said start position in response to a signal fed from said position detecting means; and (c) to drive said pump motor thereby to start the sucking and turning over operations by said plurality of suction tubes, when the vacuum force in said one suction tube reaches a predetermined level, in response to a signal fed from said vacuum pressure detecting means; and (d) to detect a time period for which said one suction tube is set in said start position, before said sucking and turning over operations are started, thereby to effect, in case a predetermined time period has lapsed, the inversely resetting operations in which said counter motor is inversely driven to set others of said suction tubes in said start positions.

7. A paper sheet counting machine as set forth in claim 6, wherein said position detecting means includes a position sensor for detecting both said stand-by and said start positions.

8. A paper sheet counting machine as set forth in claim 6, wherein said plurality of suction tubes are rotated in a first direction at a low speed so that one of said plurality of suction tubes is set at said stand-by position in response to the signal fed from said position detecting means.

9. A paper sheet counting machine as set forth in claim 8, wherein said suction tubes are rotated in a second direction opposite to said first direction at a low speed so that said plurality of suction tubes are set at said start positions in response to the signal fed from said position detecting means.

10. A paper sheet counting machine as set forth in claim 6, wherein said suction tubes are driven by the counter motor having a high stopping torque.

11. A paper sheet counting machine comprising:

a holder for holding paper sheets en masse in an open position for charging said paper sheets and in a closed position for counting said paper sheets;

a rotary cylinder rotatable on its axis;

a vacuum pump being in communication with said rotary cylinder;

a plurality of suction tubes rotatably received in said rotary cylinder to revolve on their respective axes and to revolve around the axis of said rotary cylinder and being in communication with said vacuum pump through said rotary cylinder for sucking and turning over said paper sheets one by one by a vacuum force;

means for sequentially counting the paper sheets turned over by said plurality of suction tubes;

a counter motor for rotationally driving said plurality of suction tubes to a stand-by position and a start position;

a holder motor for swinging said holder between said open position and said closed position;

a pump motor for driving said vacuum pump to establish said vacuum force;

position detecting means for detecting when one of said plurality of suction tubes is in said stand-by position, in which said one tube correctly faces the paper sheets in said closed position, and when one of said plurality of tubes is in said start position;

vacuum pressure detecting means for detecting the vacuum force in said suction tubes; and a control unit operating:

(a) to drive said counter motor, after said counter motor has driven said holder motor to set said holder in said open position, thereby to set one of said plurality of suction tubes in said stand-by position in response to a signal fed from said position detecting means;

(b) to inversely drive said counter motor, after said counter motor has driven said holder motor to set said holder in said closed position, thereby to set said one suction tube in said start position in response to a signal fed from said position detecting means; and (c) to drive said pump motor thereby to start the sucking and turning over operations by said plurality of suction tubes, when the vacuum force in said one suction tube reaches a predetermined level, in response to a signal fed from said vacuum pressure detecting means;

(d) to detect a time period for which said one suction tube is set in said start position, before said sucking and turning over operations are started, thereby to effect, in case a predetermined time period has lapsed, the inversely resetting operations in which said counter motor is inversely driven to set others of said suction tubes in said start positions; and (e) to stop the whole machine in case said inversely resetting operations are conducted continuously a predetermined number of times.

12. A paper sheet counting machine as set forth in claim 11, wherein said position detecting means includes a position sensor for detecting both said stand-by and said start positions.

13. A paper sheet counting machine as set forth in claim 11, wherein said plurality of suction tubes are rotated in a first direction at a low speed so that one of said plurality of suction tubes is set at said stand-by position in response to the signal fed from said position detecting means.

14. A paper sheet counting machine as set forth in claim 13, wherein said suction tubes are rotated in a second direction opposite to said first direction at a low speed so that said plurality of suction tubes are set at said start positions in response to the signal fed from said position detecting means.

15. A paper sheet counting machine as set forth in claim 11, wherein said suction tubes are driven by the counter motor having a high stopping torque.

* * * * *